US010404020B2

(12) United States Patent
Piromalli

(10) Patent No.: US 10,404,020 B2
(45) Date of Patent: Sep. 3, 2019

(54) MULTI-CHANNEL CONNECTOR

(71) Applicant: LINK S.R.L., Rome (IT)

(72) Inventor: Marco Piromalli, Rome (IT)

(73) Assignee: LINK S.R.L., Rome (IT)

( * ) Notice: Subject to any disclaimer, the term of this patent is extended or adjusted under 35 U.S.C. 154(b) by 0 days.

(21) Appl. No.: 15/960,479

(22) Filed: Apr. 23, 2018

(65) Prior Publication Data

US 2018/0241163 A1 Aug. 23, 2018

Related U.S. Application Data

(63) Continuation-in-part of application No. PCT/IT2016/000249, filed on Oct. 24, 2016.

(30) Foreign Application Priority Data

Oct. 23, 2015 (IT) ..... 102015000064971

(51) Int. Cl.

| | |
|---|---|
| ***H01R 13/64*** | (2006.01) |
| ***H01R 24/40*** | (2011.01) |
| ***H01R 12/53*** | (2011.01) |
| ***H01R 13/04*** | (2006.01) |
| ***H01R 13/10*** | (2006.01) |

(Continued)

(52) U.S. Cl.

CPC ..... *H01R 24/40* (2013.01); *H01R 12/53* (2013.01); *H01R 13/04* (2013.01); *H01R 13/10* (2013.01); *H01R 13/631* (2013.01); *H01R 13/642* (2013.01); *H01R 13/6592* (2013.01);

(Continued)

(58) Field of Classification Search

CPC ..... H01R 13/652; H01R 13/642; H01R 13/6592; H01R 13/04; H01R 13/631; H01R 2103/00; H01R 24/00; H01R 12/53

See application file for complete search history.

(56) References Cited

U.S. PATENT DOCUMENTS 6,386,913 B1 5/2002 Mohammad et al.
8,052,480 B2 * 11/2011 Hauser ..... H01R 13/24 439/672

(Continued)

FOREIGN PATENT DOCUMENTS

DE 20 2015 103946 U1 8/2015
EP 1 180 817 A2 2/2002

(Continued)

OTHER PUBLICATIONS

Machine-generated English language translation of description and claims of DE 20 2015 103946 U1 (Aug. 7, 2015).

(Continued)

*Primary Examiner* — Xuong M Chung Trans
(74) *Attorney, Agent, or Firm* — Hershkovitz & Associates, PLLC; Abe Hershkovitz

(57) ABSTRACT

The present invention relates to a multi-channel connector for cables for the transportation of both power lines and data signals, the connector comprising a plurality of phase contacts or hot/live contacts, a corresponding plurality of neutral contacts, and at least a corresponding plurality of earth contacts. The contacts are configured in such a way as to transmit electric current to power electrical devices. Furthermore, at least one of the earth contacts is a coaxial contact configured in such a way as to transmit data signals.

20 Claims, 6 Drawing Sheets

(51) Int. Cl.

| | |
|---|---|
| ***H01R 13/631*** | (2006.01) |
| ***H01R 13/642*** | (2006.01) |
| ***H01R 13/6592*** | (2011.01) |
| *H01R 13/652* | (2006.01) |
| *H01R 24/50* | (2011.01) |
| *H01R 103/00* | (2006.01) |

(52) U.S. Cl.
CPC ..... *H01R 13/652* (2013.01); *H01R 24/50* (2013.01); *H01R 2103/00* (2013.01)

(56) References Cited

U.S. PATENT DOCUMENTS

| | | | |
|---|---|---|---|
| 2005/0106947 | A1 | 5/2005 | Waters et al. |
| 2006/0099860 | A1 | 5/2006 | Waters et al. |
| 2008/0249363 | A1 | 10/2008 | Nakamura et al. |

FOREIGN PATENT DOCUMENTS

| | | | |
|---|---|---|---|
| EP | 1 180 817 | A3 | 4/2003 |
| EP | 1 839 559 | A1 | 10/2007 |

OTHER PUBLICATIONS

Search Report in Italian Patent Application No. IT 102015000064971 (UB2015A004953), dated Jun. 29, 2016.
Written Opinion in Italian Patent Application No. IT 102015000064971 (UB2015A004953), dated Jun. 29, 2016.
International Search Report in International Application No. PCT/IT2016/000249, dated Mar. 10, 2017.
International Preliminary Report on Patentability in International Application No. PCT/IT2016/000249, dated Apr. 24, 2018.

* cited by examiner

MULTI-CHANNEL CONNECTOR

The present invention relates to a multi-channel connector.

More precisely, the present invention relates to a connector capable of carrying both electrical lines (up to 600 V; 25 A max per line) and network information or data (such as Ethernet, ACN, DMX, Audio and Video both digital and analog, RS, etc.).

In the entertainment field (for television, music, theater, events etc.) 19-pin connectors (pins or contacts) for cables are commercially available, which are made by different manufacturers, and are totally compatible with the connector Socapex®, 419 AR Series, which is able to carry six electric circuits for the power supply of six respective electrical devices, such as for example fixed or motorized light sources, amplified loudspeakers, etc.

Said known connectors have six phase contacts or hot/live pin, six neutral or neutral pin contacts, six earth contacts or earth pins, and also a central earth pin (in common or not with the others) for the technical mass (metal chassis of equipments, metal structures, etc.).

In order to transmit, in addition to the above 6 electric circuits, also data, additional information or control commands to the devices to be powered, separate cables with their own connectors are commonly used. This implies that for each device a large number of cables and connectors are required for both its powering and for of information transportation, causing problems of time for the connection of several cables and connectors and non-neglectable logistical problems.

The object of the present invention is to obtain a multi-channel connector for cables, which is capable of transmitting both power and the data useful for the control of electrical devices to be powered, which at the same time is compatible with the available connectors currently on the market.

It is subject-matter of the present invention a multi-channel connector for cables for the transport of both power lines and data signals, said connector comprising a plurality of phase contacts, a corresponding plurality of neutral contacts, and at least a corresponding plurality of earth contacts, said contacts being configured so as to transmit electric current to power electrical devices, said connector being characterized in that at least one of said earth contacts is a coaxial contact configured in such a way as to further transmit data signals.

In particular according to the invention, said plurality of earth contacts can be soldered or welded to a respective PCBs.

Always according to the invention, said connector may comprise six phase contacts, six neutral and six earth, four of them being optionally of the coaxial type, said phase contacts and said neutral contacts can be arranged radially on an outer circumference, said earth contacts can be arranged internally to the outer circumference to form a hexagon, and said coaxial contacts can be arranged on the corners of two opposite sides of the hexagon.

Still according to the invention, said connector may comprise an additional earth contact for earthing of the technical mass.

Furthermore according to the invention, said additional earth contact can be placed at the center of said outer circumference.

Furthermore, according to the invention, said at least one coaxial contact can comprise an outer body, which forms the outer wall of the respective earth contact, a central data contact, and at least one insulating portion disposed between said central data contact and said outer body for electrically isolating the earth contact from the data contact.

Furthermore according to the invention, said connector may be a male connector, in which said contacts may be pins or a female connector in which said contacts can be cavities.

Still according to the invention, said central data contact of said coaxial pin of said male connector may be a central cavity formed above said pin.

Finally, according to the invention, said central data contact of said coaxial cavity of said female connector can be a central pin arranged below said coaxial cavity.

The invention will be now described, for illustrative but not limitative purposes, with particular reference to the figures of the accompanying drawings, in which.

Figure 1:
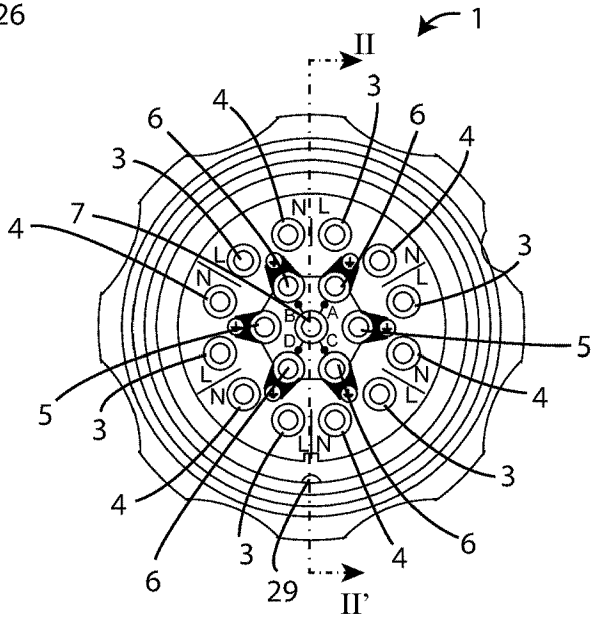
FIG. 1 shows a top view of the male type portion of a multi-channel connector according to the invention.

Referring to FIGS. 1-8, a multi-channel connector for cables according to the invention is observed, comprising a male portion or male connector, indicated with reference numeral 1 and shown in FIGS. 1-3 and 7, and a female portion or female connector, indicated by the reference number 2 and shown in FIGS. 4-6 and 8.

Said connector is configured so as to include a plurality of phase contacts or hot/live 3 and 8, namely six, an equal plurality of neutral contacts 4 and 9, namely six, and an equal plurality of earth contacts 5, 6, 10 and 11, namely six.

Each set of respective phase contacts 3 and 8, neutral contacts 4 and 9, and earth contacts 5 or 6 and 10 or 11 is configured so as to transmit electric current to power a respective electrical device, such as a light source. Therefore, the specific connector according to the invention in the embodiment shown in the figures has six different circuits that allow the feeding of six or more electrical devices.

Furthermore, at least one of said earth contacts 6 and 11, specifically four of them, is of a coaxial type contact comprising a data contact configured in such a way as to further transmit data signals, for example of Ethernet type, DMX, serial video, digital or analog audio, other serial signals etc.

In other embodiments, all of the earth contacts can be of the coaxial type in order to increase the data contacts.

As it can be seen from the accompanying figures, each contact is constituted by a pair consisting of a male pin and a female cavity, each respectively housed in the respective male portion 1 and female portion 2 of the connector according to the invention and mutually coupled by means of coupling means 26, 27 which will be described below.

Figure 2:
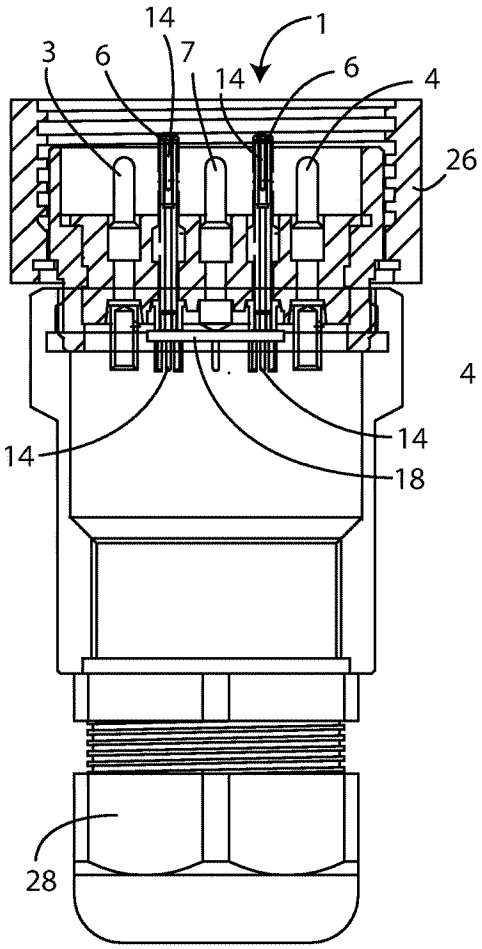
FIG. 2 shows a front sectional view of the portion of FIG. 1 along the sectional plane II-II'.
Figure 3:
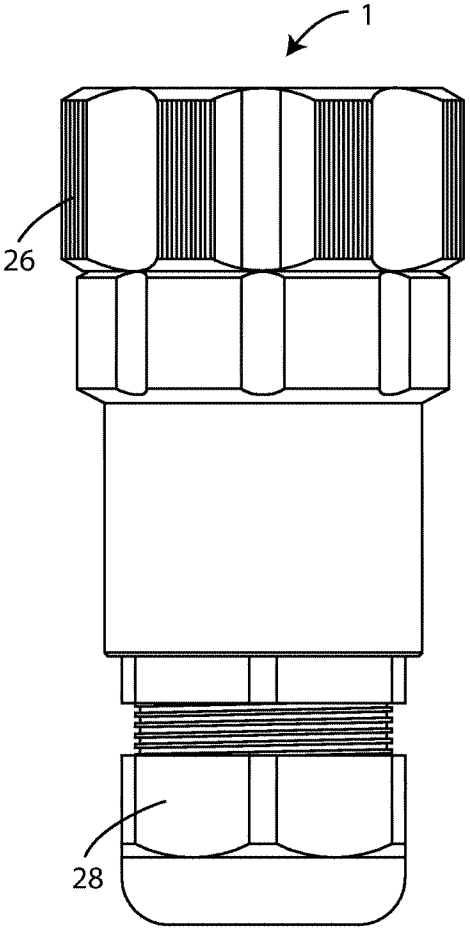
FIG. 3 shows a front view of the portion of FIG. 1.
Figure 4:
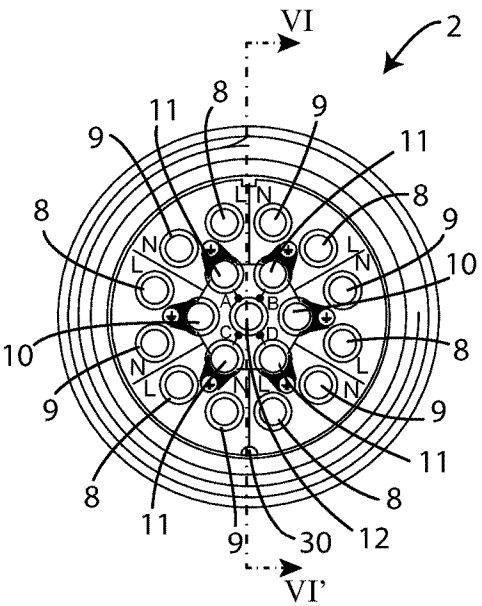
FIG. 4 shows a top view of the female type portion of the multi-channel connector according to the invention.
Figure 5:
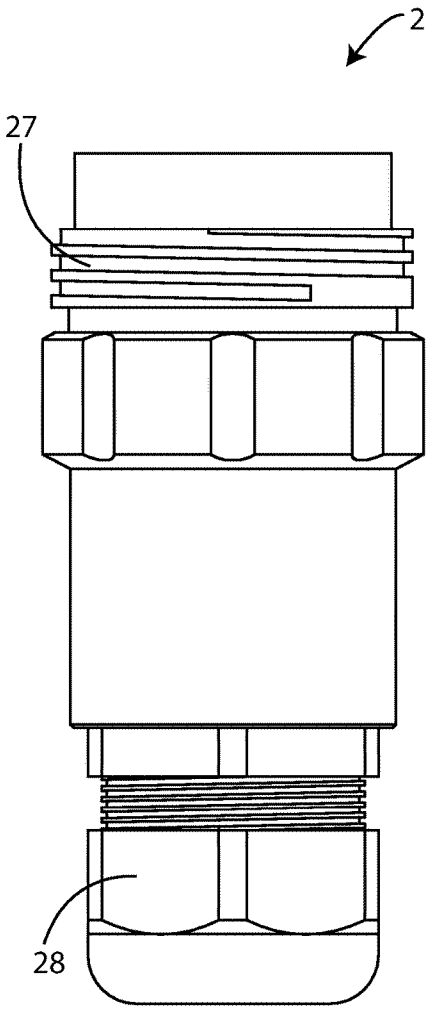
FIG. 5 shows a front view of the portion of FIG. 4.
Figure 6:
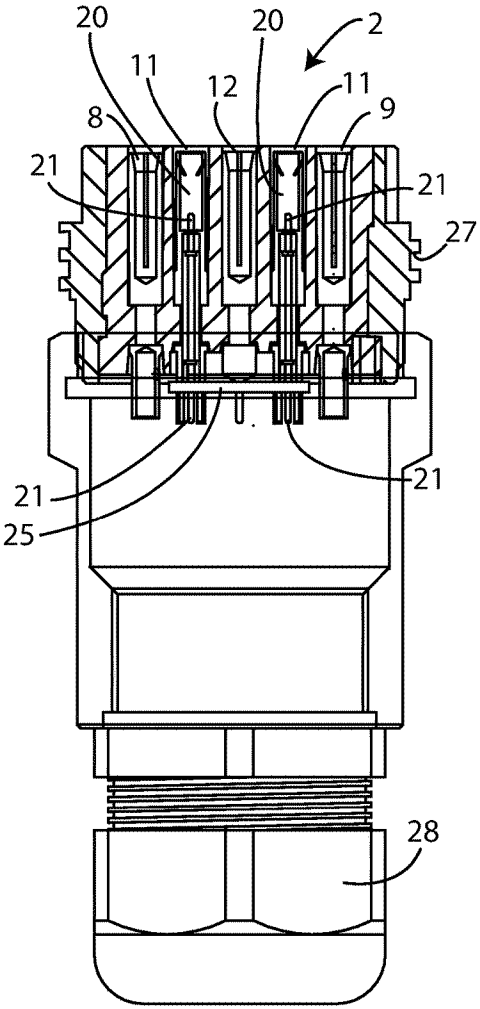
FIG. 6 shows a front sectional view of the portion of FIG. 5 along the sectional plane VI-VI'.

Referring specifically to FIGS. 1-3, said male connector 1 comprises a plurality of phase pins or hot/live pin 3, namely six, an equally populated plurality of neutral pins 4, namely six, and an equally populated plurality of earth pins 5 and 6, namely six.

At least one of said earth pins 6 is a coaxial pin capable of transmitting data signals, specifically four of said earth pins are of the coaxial type 6. Said earth pins 5 and 6 are all blocked, in particular welded or soldered, at their lower ends to a PCB or printed circuit board 18 having a dedicated track that realizes a common earth ring. This common earth ring in the prior art is made either physically with the cables or with conductive rings that pool the pin masses. This ring, in the prior art, must be welded or crimped to the pin contacts, making the construction process of the connector more complex and slower.

In other embodiments, said earth pins may have different terminals, not necessarily crimped or soldered/welded to a PCB.

The respective female portion or female connector 2 then comprises a plurality of phase cavities 8, the same number of phase pins 3 of the male portion 1, namely six, an equally populated plurality of neutral cavities 9, namely six, and an equally populated plurality of earth cavities 10 or 11, namely six. Said earth cavities 10 and 11 are all blocked, in particular welded/soldered, at their lower ends to a PCB or printed circuit board 25 having a dedicated track that realizes a common earth ring.

In other embodiments said earth cavity may have several terminals, not necessarily crimped or soldered/welded to a PCB.

Said cavities 8, 9, 10 and 11 and the pins 3, 4, 5 and 6 of the respective female 2 and male portions 1 are arranged in such a way that by coupling the two portions 1 and 2 of the connector, each pin 3, 4, 5 and 6 is coupled with the respective cavity 8, 9, 10 and 11, forming the respective contact for the transmission of power lines and data to the cables connected to said connector.

In the embodiment shown in the figures, said contacts are arranged in such a manner that each male 1 or female portion 2 is connectable to a respective male or female portion of a connector of the known type for the power supply of electrical devices, in the embodiment shown in said figures, said known compatible connector is a 19-pin connector also known commercially under the brand Socapex® or Socapex® compatible or Socapex®-type without compromising the compatibility.

Said coaxial contacts 6 and 11 are in fact configured in such a way that when they are coupled to a respective common connector Socapex®, they do not jeopardize its normal operation, while maintaining the contact with the respective pins of the traditional connector. Thus, in the case of traditional/subject-of-the-invention connector mixed coupling, only the transmission of additional data signals is lacking.

In particular, for coupling with a Socapex® or Socapex® compatible connector, said phase contacts 3 and 8 and said neutral 4 and 9 contacts are arranged radially on an outer circumference, said earth contacts 5 and 6 and 10 and 11 are arranged internally to the outer circumference to form a hexagon, with coaxial contacts 6 and 11 arranged on the corners of the two opposite sides of the hexagon and the earth contacts 5 and 10 arranged on the two remaining opposite corners of the hexagon.

Furthermore, said connector according to the invention can have an additional earth contact 7 and 12 (earth pin 7 for the male portion 1 and earth cavities 12 for the female portion 2) for the earthing of technical mass. Also said further earth contact 7 and 12 may be a coaxial contact for the transmission of data signals, that is to be welded to the respective PCBs 18 and 25 therefore increasing the possible data contacts, without compromising the compatibility with existing connectors, such as 19-pin connector type Socapex® or Socapex®-compatible.

In the embodiment shown in the figures, said further earth contact 7 and 12 is disposed at the center of the outer circumference.

As shown in the accompanying figures, said portions 1 and 2 of the connector according to the present invention can advantageously present also alignment means 29 and 30 suitable to facilitate the alignment between the two portions 1 and 2 when they are coupled to each other.

Specifically they are an alignment pin 29 disposed in the male portion 1 and a respective alignment cavity 30 disposed in the female portion 2.

Figure 7:
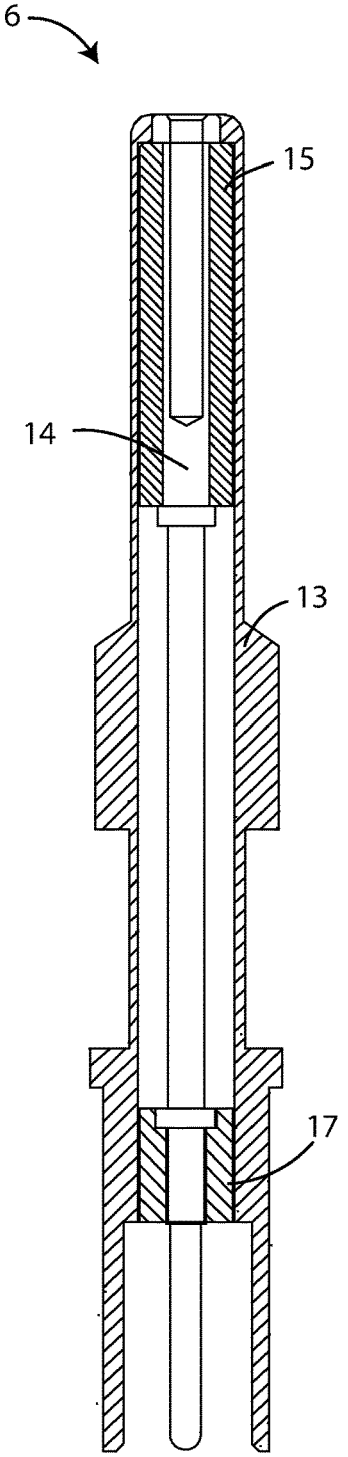
FIG. 7 shows a front sectional view of a perfected pin of the male type portion of FIG. 1.
Figure 8:
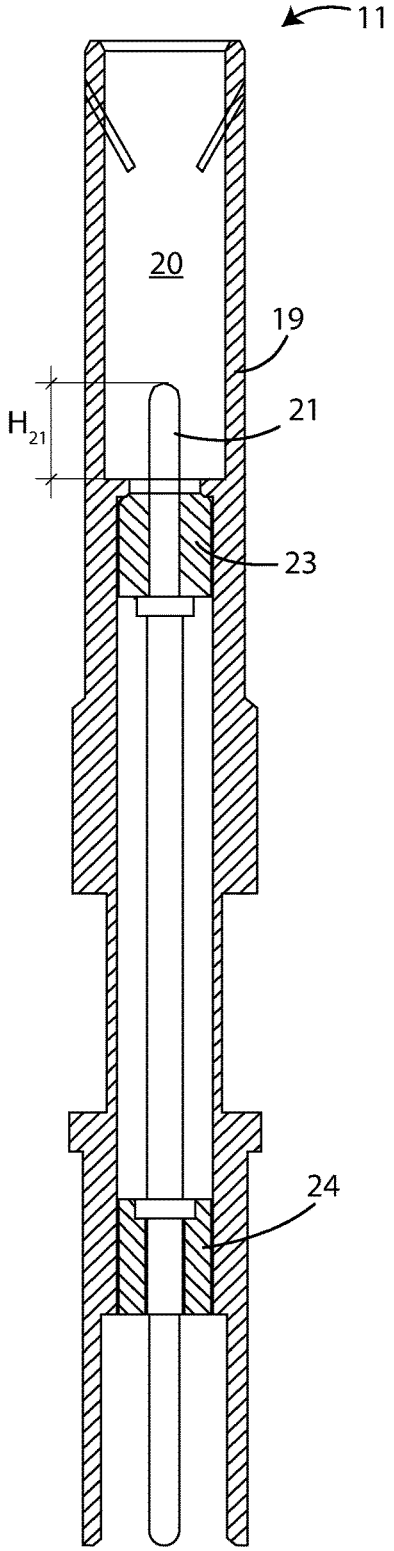
FIG. 8 shows a front sectional view of an improved pin of the female type portion 5.

Moreover, by making particular reference to FIGS. 7 and 8, said coaxial contacts 6 and 11 are also constituted by a male pin 6, housed in the male portion of the connector 1, and by a female cavity 11, housed in the female portion 2 of said connector.

Said male coaxial pin 6 comprises an outer body 13, which forms the outer wall of the earth pin 6, a central cavity 14 or central data contact, for the transmission of data signals, formed at the upper end of the pin 6 and in contact with said PCB 18 at its bottom, a top insulator portion 15, disposed between the cavity 14 and the external body 13, able to electrically insulate the central cavity 14 from the outer body 13. In addition, the pin 6 comprises a second lower insulating portion 17, disposed between said central cavity 14 and the outer body 13 to isolate said central cavity 14 from the outer body 13, which is also welded/soldered at its lower end to the PCB 18.

The coaxial cavity 11 of the female portion 2 of the connector according to the invention comprises, as shown in FIG. 8, an outer body 19 in which a central cavity 20 is superiorly provided, which forms the outer wall of the earth cavity 11, a central pin 21 or central data contact for transmission of data signals arranged in the lower portion of the central cavity 20 and at the bottom in contact with said PCB 25, on which they are welded/soldered. Between said central pin 21 and said outer body 19 two insulating portions 23 and 24 are disposed in correspondence, to electrically isolate the data contact 21 from the exterior earth contact 11.

In particular, the center pin 21 has a height $h_{21}$ such to engage and be in contact with the cavity 14 of the coaxial male pin 6 and that cannot be touched and/or damaged by a traditional Socapex® or Socapex-compatible pin, in the case of mixed coupling. Preferably the height $h_{21}$ is between 0.5 and 3 mm, for example 2.5 mm.

The coaxial contacts 6 and 11 according to the invention have the advantage of having a smaller number of components compared to the prior art contacts and to enable the easy connection of two separate individual wires, and being fixable in the PCB also within cable connectors and not only for panel connectors.

Preferably, the two portions 1 and 2 of the connector according to the invention are coupled to each other by means of a closing ring 26, in particular made of metal or metal/rubber, disposed on a first portion 1 and able to be screwed on a screw portion 27 disposed on the second portion 2. Furthermore, the attack 28 to the cable is of the water-tight IP67 type.

Figure 9:
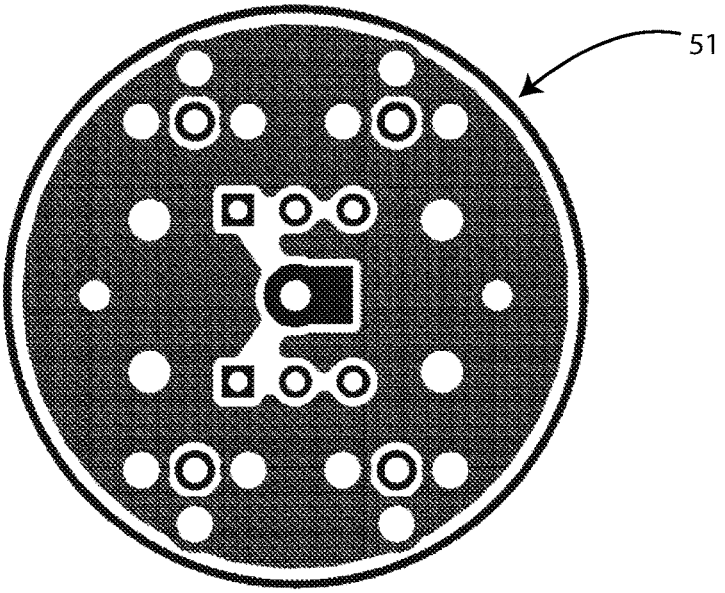
FIG. 9 shows a first side of the PCB according to the invention, in which the full dotted white represents the earth mass connections, the dotted white circled line displays the signal connections and the blank spaces show where the conductive tracks run.
Figure 10:
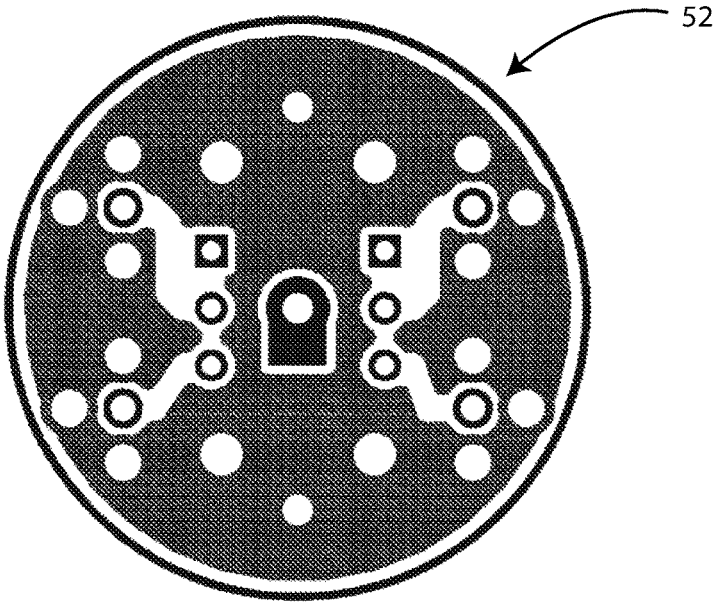
FIG. 10 shows a second side of the PCB according to the invention, in which the dotted line represents the earth mass; the white spaces show where the conductive tracks run.
Figure 11:
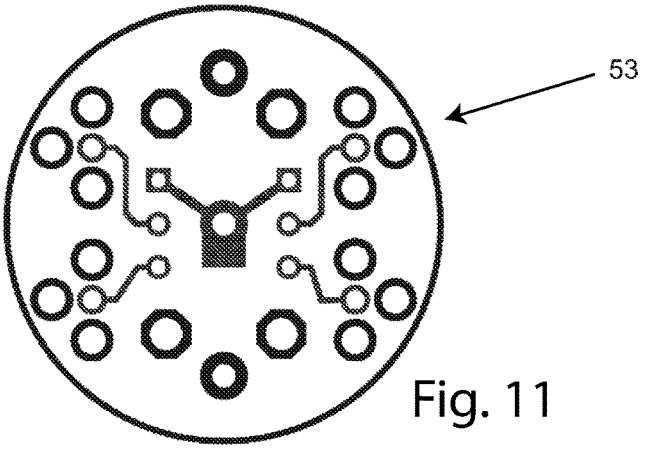
FIG. 11 shows in dotted line the slopes shown in white in FIGS. 9 and 10.

Referring to FIGS. 9 to 11, an example of the PCB according to the invention shows a double layer (first side 51 in FIG. 9 and second opposite side 52 in FIG. 10, in both FIGS. 9 and 10 the white spots representing the full mass connections and circled points representing the signal connections) connected with a earth mass on both sides to obtain a sufficient value of total earth mass, for example a resistance smaller than 0.1 Ohm (and in any case a value not exceeding the maximum resistance value of a earth contact required by the standard). FIG. 11 shows a version 53 with the tracks in black.

Figure 12:
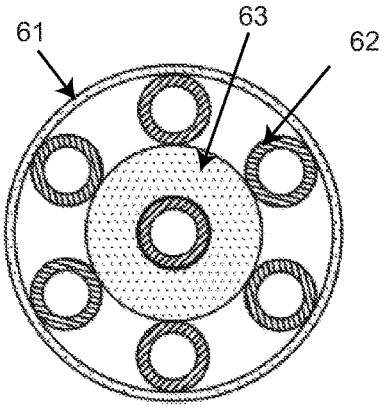
FIG. 12 shows a first earth mass ring used in prior art connectors.
Figure 13:
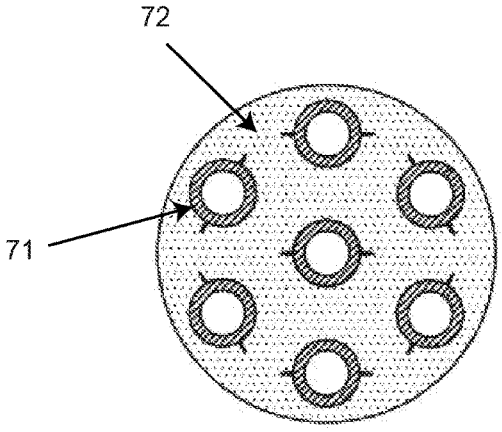
FIG. 13 shows a second earth mass ring used in prior art connectors.

Instead, in the known art, the earth mass was realized as in FIGS. 12 and 13 (the white parts are empty parts).

In FIG. 12, a first type of mass ring (consisting of two inner 62,63 and outer 61 rings, the outside ring being the thinnest one) is shown, which is usable with both contacts to be soldered/welded and contacts to be crimped. In the first case, two inner and outer rings are inserted, and then the (two) earth cables are welded/soldered onto any two pins of the outer circumference. In case of use of crimp pin, the construction of the connector provides for fixing 5 pin out of 7 on the same connector, and subsequently the two mass rings: first the internal one 62,63, then the two crimp contacts are mounted to related earth cables, then the two contacts are mounted in the connector and finally the outer ring 61 is inserted. The assembly process is therefore very slow and complicated.

In the second figure (13), a soldering/welding version only is given, in which the connector is provided to the user with all the pins already inserted. Disk 72 is inserted by pressure on the back side of the pin, and then two earth cables are welded on any two contacts of the external earth crown (the one with the six holes 71). Weldings/solderings are slow and harmful operations.

Figure 14:
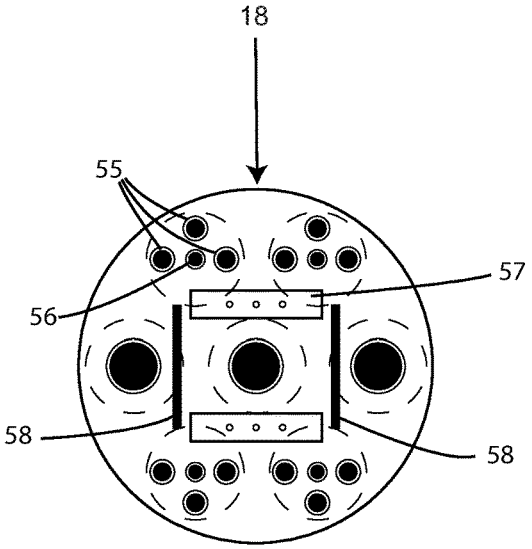
FIG. 14 shows an example of a PCB according to the invention that replaces also the mass rings according to the prior art.

Referring to FIG. 14, in the case of the PCB 18 according to the invention, the PCB 18 serves a dual function of connection of the signals and of mass ring. The pins have been inserted into the coaxial contact bodies 55, 56. The user will only have to connect the earth wire to the two Faston contacts 58 (in general one or more) and the relevant signals to the two signals micro-connectors 57 (generally one or more).

Figure 15:
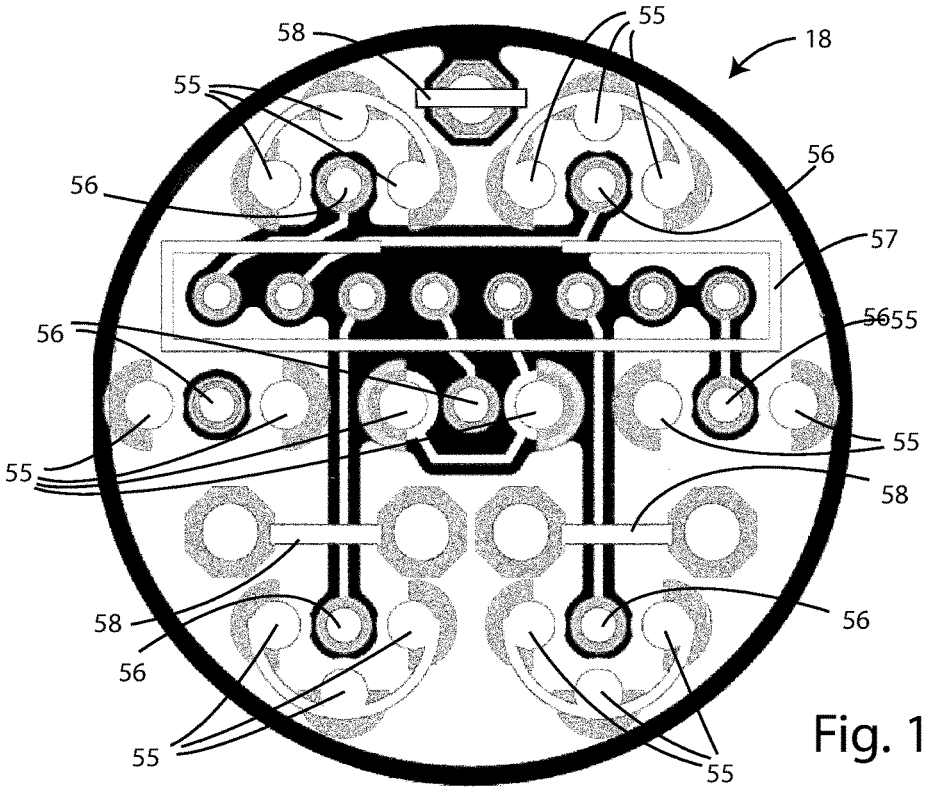
FIG. 15 shows a first side a further example of a PCB according to the invention.
Figure 16:
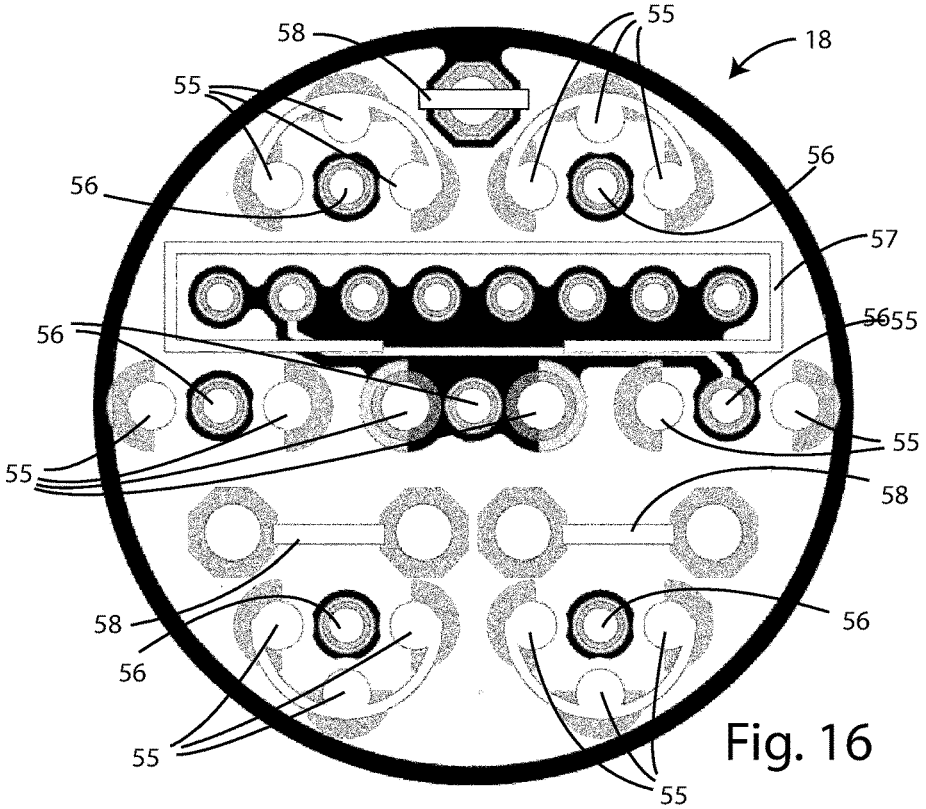
FIG. 16 shows a second side of the PCB of FIG. 15.

With reference to FIGS. 15 and 16 it is shown a further embodiment of the PCB according to the invention, which differs from the one previously shown in that:

- it is provided one micro-connector 57 in place of two;
- the faston connectors or contacts 58 are three and are in a different arrangement, in particular there is a third faston connector 58 for shielding the cable; and
- all the seven contacts 55, 56 on the PCB 18 are coaxial, the six outer contacts 55 are signal/ground and the central contact 56 is signal/signal.

Among the difficulties in designing the PCB according to the invention, there are:

- Difficulties in finding a system to make accessible to all the connection of the signal cables to the PCB ensuring the absence of short-circuits and the signal integrity. To this, the two micro-connectors (providing as default also the cable versions, so that the user does not have to operate on the PCB) have been added.
- Guaranteeing the application of the mass tracks, despite the small space. To do this, it was necessary to realize a mass track per side, joining them to each other by means of pins fixing holes pins and fastons.
- Finding a solution that would make the PCB usable both for the male and the female connector, without changing the pinout of the two data connectors.
- Arranging the components so as to make the assembly of the same possible, in an easy way and without the risk of short circuits.
- Modifying the coaxial pins bringing from 4 to 3 the mass anchors to make room for data connectors, while still guaranteeing an adequate mechanical strength.

Of course, the portions 1 and 2 of the connector according to the invention can be configured in such a way as to be suitable to the panel or cables mounting.

In the foregoing, preferred embodiments have been described and variants of the present invention have been suggested, but it is to be understood that those skilled in the art can make modifications and changes, without so departing from the related scope of protection, as defined by the attached claims.

The invention claimed is:

1. Multi-channel connector for cables for transportation of power lines, up to 600 V and 25 A max per line, and data signals, the data signals being one of, network information or data, said connector comprising a plurality of phase contacts, a corresponding plurality of neutral contacts, and at least a corresponding plurality of earth contacts, said contacts being configured to transmit electric current to power electrical devices, wherein:

- at least one of said earth contacts is a coaxial contact configured to further transmit data signals;
- said plurality of earth contacts are welded to a respective PCB;
- said respective PCB has a dedicated track that realizes an earth ring; and in that said multi-channel connector is a female connector, in which said contacts are cavities, in that said at least one coaxial cavity has a central pin for transmission of data signals arranged on its bottom and wherein said central pin has a useful height ($h_{21}$) from said bottom dimensioned so that, during use, it is configured to engage and be in contact with the cavity of a male coaxial pin of a corresponding male multi-channel connector, and said central pin cannot be at least one of, touched and damaged by a conventional male-pin of a 19-pin Socapex® connector or of a 19-pin Socapex-compatible type, in case of coupling with the pin.

2. The connector according to claim 1, in which said height (h21) of said central pin is between 0.5 and 3 mm.

3. The connector according to claim 1, wherein the PCB comprises two connected layers.

4. The connector according to claim 1, wherein the PCB has one or more micro connectors for the data or signal cables connection as well as one or more contacts of Faston® type for connecting the earth cables.

5. The connector according to claim 2, wherein the PCB has one or more micro connectors for the data or signal cables connection as well as one or more contacts of Faston® type for connecting the earth cables.

6. The connector according to claim 1, comprising six phase, six neutral and six earth contacts, four of which being of the coaxial type, and in that said phase contacts and said neutral contacts are arranged radially on an outer circumference, in that said earth contacts are arranged internally to the outer circumference to form a hexagon, and in that said coaxial contacts are arranged on the corners of two opposite sides of the hexagon.

7. The connector according to claim 2, comprising six phase, six neutral and six earth contacts, four of which being of the coaxial type, and in that said phase contacts and said neutral contacts are arranged radially on an outer circumference, in that said earth contacts are arranged internally to the outer circumference to form a hexagon, and in that said coaxial contacts are arranged on the corners of two opposite sides of the hexagon.

8. The connector according to claim 3, comprising six phase, six neutral and six earth contacts, four of which being of the coaxial type, and in that said phase contacts and said neutral contacts are arranged radially on an outer circumference, in that said earth contacts are arranged internally to the outer circumference to form a hexagon, and in that said coaxial contacts are arranged on the corners of two opposite sides of the hexagon.

9. The connector according to claim 4, comprising six phase, six neutral and six earth contacts, four of which being of the coaxial type, and in that said phase contacts and said neutral contacts are arranged radially on an outer circumference, in that said earth contacts are arranged internally to the outer circumference to form a hexagon, and in that said coaxial contacts are arranged on the corners of two opposite sides of the hexagon.

10. The connector according to claim 1, comprising an additional earth contact for the earthing of technical mass.

11. The connector according to claim 2, comprising an additional earth contact for the earthing of technical mass.

12. The connector according to claim 3, comprising an additional earth contact for the earthing of technical mass.

13. The connector according to claim 4, comprising an additional earth contact for the earthing of technical mass.

14. The connector according to claim 5, comprising an additional earth contact for the earthing of technical mass.

15. The connector according to claim 14, wherein said additional earth contact is arranged at the center of said outer circumference.

16. The connector according to claim 1, further comprising an alignment mechanism for alignment with a further connector.

17. The connector according to claim 1, wherein said at least one coaxial contact comprises an outer body, which forms the outer wall of the respective earth contact, a central data contact, and at least one insulating portion disposed between said central data contact and said outer body to electrically isolate the earth contact from the data contact.

18. The connector according to claim 1, comprising a female connector portion and a male connector portion configured to be coupled to said female connector portion, said male connector portion comprising a plurality of phase pins, a corresponding plurality of neutral pins, and at least a corresponding plurality of earth pins, said pins being configured so as to transmit electric current to power electrical devices, wherein:

at least one of said earth pins of said male connector portion is a coaxial pin configured to further transmit data signals;

said plurality of earth contacts of said male connector portion being welded to a respective PCB; and said respective PCB of said male connector portion having a dedicated track that realizes an earth ring, and wherein said coaxial pin of said male connector portion has a central cavity formed on the upper end of said coaxial pin.

19. The connector according to claim 1, wherein the one of, network information or data, comprising one of, Ethernet, ACN, DMX, Audio and Video both digital and analog, and RS.

20. The connector according to claim 1, in which said height ($h_{21}$) of said central pin is 2.5 mm.

* * * * *